US011752387B2

(12) United States Patent
Homayouni

(10) Patent No.: US 11,752,387 B2
(45) Date of Patent: Sep. 12, 2023

(54) EXERCISE BAR

(71) Applicant: Delsa LLC, Vienna, VA (US)

(72) Inventor: Azad Homayouni, Vienna, VA (US)

(73) Assignee: Delsa LLC, Vienna, VA (US)

( * ) Notice: Subject to any disclaimer, the term of this patent is extended or adjusted under 35 U.S.C. 154(b) by 46 days.

(21) Appl. No.: 17/493,025

(22) Filed: Oct. 4, 2021

(65) Prior Publication Data

US 2022/0176191 A1 Jun. 9, 2022

Related U.S. Application Data

(60) Provisional application No. 63/121,713, filed on Dec. 4, 2020.

(51) Int. Cl.

| | |
|---|---|
| ***A63B 21/00*** | (2006.01) |
| ***A63B 71/00*** | (2006.01) |
| ***A63B 23/12*** | (2006.01) |

(52) U.S. Cl.

CPC ..... *A63B 21/4033* (2015.10); *A63B 23/1236* (2013.01); *A63B 71/0036* (2013.01); *A63B 2225/093* (2013.01)

(58) Field of Classification Search

CPC ..... A63B 23/1209; A63B 23/128; A63B 23/1227; A63B 23/1236; A63B 21/4035; A63B 1/00; A63B 71/0036

See application file for complete search history.

(56) References Cited

U.S. PATENT DOCUMENTS

| | | | | |
|---|---|---|---|---|
| 3,430,955 | A * | 3/1969 | Mack | A63B 23/12 482/131 |
| 5,205,802 | A * | 4/1993 | Swisher | A63B 21/00047 482/141 |
| 7,604,582 | B2 | 10/2009 | Abdallah | |
| 7,824,319 | B2 | 11/2010 | Carlesimo | |
| 9,789,346 | B1 * | 10/2017 | Kime | A63B 23/1227 |
| 9,895,564 | B1 * | 2/2018 | Katz | A63B 23/0211 |
| 9,950,206 | B2 * | 4/2018 | Biddix, Jr. | A63B 17/04 |
| 11,351,408 | B2 * | 6/2022 | Landsman | A63B 71/023 |
| 2009/0023566 | A1 * | 1/2009 | Florczak | A63B 21/4035 482/142 |
| 2010/0190612 | A1 * | 7/2010 | Cook | A63B 71/023 482/148 |

* cited by examiner

*Primary Examiner* — Sundhara M Ganesan
*Assistant Examiner* — Zachary T Moore
(74) *Attorney, Agent, or Firm* — Maskell Law PLLC; Benjamin E. Maskell

(57) ABSTRACT

Disclosed is an exercise device includes an elongated body having a top surface, bottom surface, a first end surface and a second end surface, a first bore hole located proximate the first end surface, the first bore hole extending from the top surface through to the bottom surface, a first vertical member sized in relative proportions to be slidably received in the first bore hole, a first locking hole orthogonal to the first bore hole, a first pin sized in relative proportions to be slidably received in the first locking hole, and a first height adjustment hole of the first vertical member, the first height adjustment hole sized in relative proportions to slidably receive the first pin.

14 Claims, 5 Drawing Sheets

EXERCISE BAR

This application is a continuation-in-part of U.S. Application 63/121,713 filed Dec. 4, 2020 the entirety of which is hereby incorporated by reference.

BACKGROUND OF THE INVENTION

Field of the Invention

The embodiments of the invention relate to exercise equipment, and more particularly, to exercise equipment for doing pushups and other body-weight exercises. Although embodiments of the invention are suitable for a wide scope of applications, it is particularly suitable for doing pushups.

Discussion of the Related Art

The related art exercise equipment includes, for example, U.S. Pat. No. 7,824,319 to Carlesimo et. al. ("Carlesimo"). Carlesimo discloses, generally, a series of stackable blocks that can be used to create platforms of varying heights. The blocks of Carlesimo can have interlocking features so that the blocks do not slide when stacked. A top-most block can have a tubular handle. A user can use the Carlesimo platforms to do a variety of exercises such as pushups and seated dips.

The related art exercise equipment also includes, for example, U.S. Pat. No. 7,604,582 to Abdallah ("Abdallah"). Abdallah discloses, generally, a pair of platforms for doing knuckle pushups. For stability, the platforms have a base that is wider than the top. The top surface has an interchangeable surface layer to enable varying selections of padding layers or textured layers while doing knuckle pushups.

The related art exercise equipment, however, is prone to a number of faults. Among other things, the related art devices have disconnected bases and are prone to tipping and sliding. It can be difficult to precisely, consistently, and repeatedly position the bases of the related art devices to target specific muscle groups or in accordance with use preference. Additionally, the related art devices lack surfaces that are ergonomically contoured. The bases of the related art devices are small in comparison to the forces that are likely to be exerted on them from intended use. This makes the related art devices subject to sliding and tipping and possibly causing injury to users.

SUMMARY OF THE INVENTION

Accordingly, embodiments of the invention are directed to an exercise bar that substantially obviates one or more of the problems due to limitations and disadvantages of the related art.

An object of embodiments of the invention is to provide an exercise device that can be precisely and repeatedly configured;

Another object of embodiments of the invention is to provide an exercise device with a stable base to prevent tipping;

Yet another object of embodiments of the invention is to provide an exercise device that is adjustable in height;

Still another object of embodiments of the invention is to provide an exercise device with ergonomically, adjustable, and interchangeable grips.

Additional features and advantages of embodiments of the invention will be set forth in the description which follows, and in part will be apparent from the description, or may be learned by practice of embodiments of the invention. The objectives and other advantages of the embodiments of the invention will be realized and attained by the structure particularly pointed out in the written description and claims hereof as well as the appended drawings.

To achieve these and other advantages and in accordance with the purpose of embodiments of the invention, as embodied and broadly described, an exercise bar includes an elongated body having a top surface, bottom surface, a first end surface and a second end surface, a first bore hole located proximate the first end surface, the first bore hole extending from the top surface through to the bottom surface, a first vertical member sized in relative proportions to be slidably received in the first bore hole, a first locking hole orthogonal to the first bore hole, a first pin sized in relative proportions to be slidably received in the first locking hole, and a first height adjustment hole of the first vertical member, the first height adjustment hole sized in relative proportions to slidably receive the first pin.

In another aspect, an exercise bar includes an elongated body having a top surface, bottom surface, a first end surface and a second end surface, a first bore hole located proximate the first end surface, the first bore hole extending from the top surface through to the bottom surface, a first vertical member sized in relative proportions to be slidably received in the first bore hole, a first plurality of height adjustment holes of the first vertical member, a second bore hole located proximate the second end surface, the second bore hole extending from the top surface through to the bottom surface, a second vertical member sized in relative proportions to be slidably received in the second bore hole, and a second plurality of height adjustment holes of the second vertical member.

In yet another aspect, an exercise bar includes an elongated body having a top surface, bottom surface, a first end surface and a second end surface, a first bore hole located proximate the first end surface, the first bore hole extending from the top surface through to the bottom surface, a first vertical member sized in relative proportions to be slidably received in the first bore hole, a second bore hole located proximate the second end surface, the second bore hole extending from the top surface through to the bottom surface, a second vertical member sized in relative proportions to be slidably received in the second bore hole, a plurality of accessory holes on the top surface of the elongated body, a first accessory attachment having a convex top and a first projection sized in relative proportions to be disposed in one of the plurality of accessory holes, and a second accessory attachment having a convex top and a second projection sized in relative proportions to be disposed in another one of the plurality of accessory holes.

It is to be understood that both the foregoing general description and the following detailed description are exemplary and explanatory and are intended to provide further explanation of embodiments of the invention as claimed.

BRIEF DESCRIPTION OF THE DRAWINGS

The accompanying drawings, which are included to provide a further understanding of embodiments of the invention and are incorporated in and constitute a part of this specification, illustrate embodiments of the invention and together with the description serve to explain the principles of embodiments of the invention.

DETAILED DESCRIPTION OF THE PREFERRED EMBODIMENTS

Figure 1:
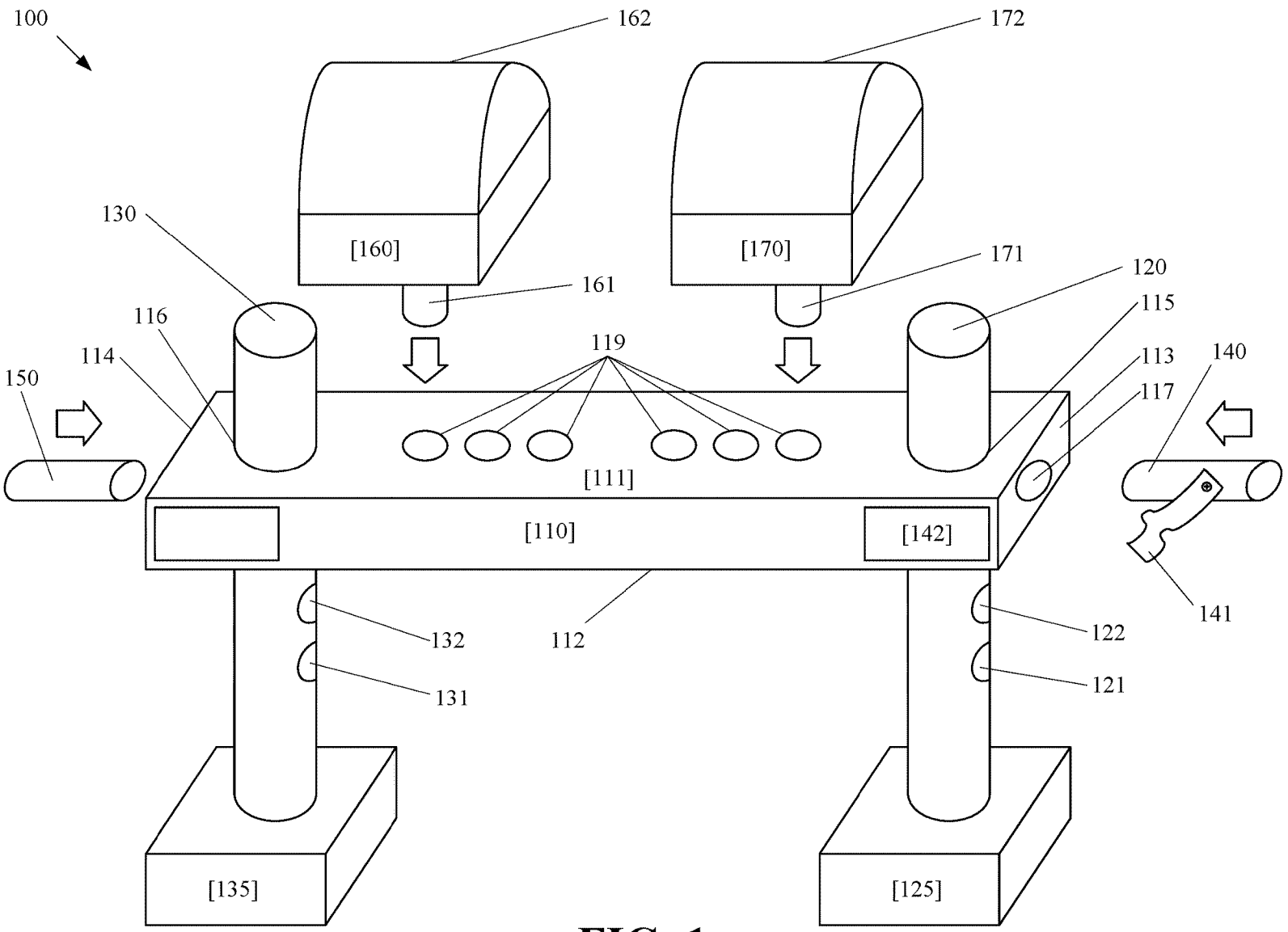
FIG. 1 is an isometric view of an exercise bar according to an exemplary embodiment of the invention.
Figure 2:
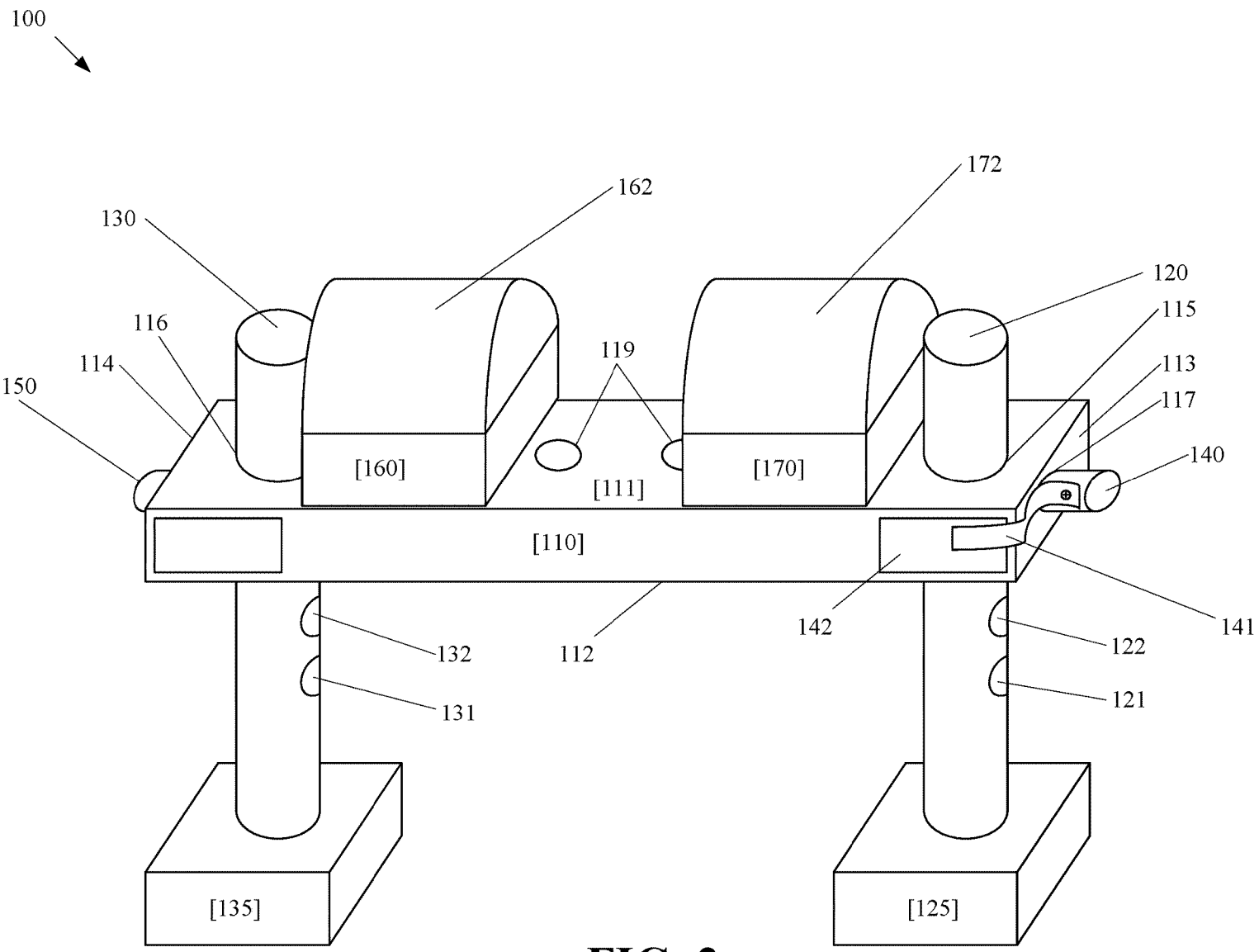
FIG. 2 is an isometric view of an exercise bar according to an exemplary embodiment of the invention.

Reference will now be made in detail to the preferred embodiments of the invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements. The proportion of elements in the drawings may be exaggerated or minimized for clarity.

FIGS. 1-4 are isometric views of an exercise bar according to an exemplary embodiment of the invention. As shown in FIGS. 1-4 an excise bar 100 includes an elongated member 110, vertical members 120 and 130, pins 140 and 150, and accessory attachments 160 and 170.

The elongated member 110 includes a top surface 111, a bottom surface 112, and two end surfaces 113 and 114. The elongated member 110 includes two bore holes 115 and 116 that extend from the top surface 111, through the elongated member 110, to the bottom surface 112. The bore holes 115 and 116 are approximately orthogonal to the top surface 111 and the bottom surface 112. End surface 113 includes locking hole 117. Locking hole 117 can be approximately orthogonal to end surface 113. Locking hole 117 can extend from the end surface 113 into the elongated member 110 and into the bore hole 115. Locking hole 117 can be approximately orthogonal to bore hole 115. Although not shown in FIG. 1, end surface 114 can also include a locking hole (FIG. 5, element 118) that extends orthogonally from end surface 114, into the elongated member 110 and can orthogonally intersect bore hole 116. Top surface 111 of the elongated member can have a plurality of accessory holes 119 that extend from the top surface 111, into the elongated member 110, and through to the bottom side 112.

Vertical members 120 and 130 can have base member 125 and 135, respectively. In the figures, base members 125 and 135 are shown as approximately square for the purpose of simplicity of illustration. Those of skill in the art will appreciate that varying dimensions of base members 125 and 135 are preferred to prevent tipping or sliding. In preferred embodiments, base members 125 and 135 are elongated, front to back, to prevent tipping of the exercise bar 100. In preferred embodiments, base members 125 and 135 are approximately half the length of elongated member 110.

Vertical member 120 can have a plurality of height adjustment holes 121 and 122. Some of the plurality of height adjustment holes of vertical member 120 are hidden from view in FIG. 1 but can be seen as elements 123 and 124 in FIG. 3. Vertical member 130 can have a plurality of height adjustment holes 131 and 132. Some of the plurality of height adjustment holes of vertical member 130 are hidden in view in FIG. 1 but can be seen as elements 133 and 134 in FIG. 5. Vertical members 120 and 130 can be sized in approximate proportions to be slidably received in bore holes 115 and 116, respectively, of the elongated member 110. Height adjustment holes can preferably extend completely through the vertical members 120 and 130. In other embodiments, height adjustment holes extend only partially into vertical members 120 and 130.

Pin 140 can be sized in approximate proportions to be slidably received in locking hole 117 and one height adjustment holes 121, 122, 123 and 124. Pin 140 can have retention member 141 that mates with mating portion 142 on the elongated body 110. Retention member 141 and mating portion 142 can retain the pin 140 in the locking hole 117 and prevent accidental slippage during vigorous exercise. Retention member 141 and mating portion 142 are preferably hook and loop fastener. Those of skill in the art will appreciate that other types of retention members can be substituted for hook and loop fastener, including, for example snaps, hooks, buttons, magnets, and toggles. Such substitutes are within the scope of the invention. Although retention member 141 and mating portion 142 have been shown and described in conjunction with pin 140, those of skill in the art will appreciate that similar structures can be used to secure other movable parts of the exercise bar 100.

Pin 150 can be sized in approximate proportions to be slidably received in a locking hole (see FIG. 5, element 118) on end surface 114 and one of height adjustment holes 131 or 132. Pin 150 can include a retention member and mating portion (not shown) in a symmetrical arrangement to pin 140. In preferred embodiments of the invention, pins 140 and 150 are slightly tapered to aid in easy insertion and removal.

Accessories attachments 160 and 170 can have projections 161 and 171 and convex tops 162 and 172, respectively. The convex tops 162 and 172 can be ergonomically contoured for human hands when doing push ups or seated dips. The convex tops 162 and 172 can be formed from a rigid material for resiliency and durability. The convex tops 162 and 172 can overlaid with a softer material such as leather or silicon for comfort. Projections 161 and 171 can be sized in relative proportions to be received in the plurality of accessory holes 119. Although projections 161 and 171 are shown in FIG. 1 as approximately cylindrical, in preferred embodiments of the inventions, projections 161 and 171 are oval or oblong to prevent the accessory attachments 160 and 170 from twisting while in use. In preferred embodiments of the invention, projections 161 and 171 are slightly tapered to aid in easy insertion and removal.

The exercise bar 100 can be configured in accordance with user preference. In the embodiment of FIG. 1, the elongated member 110 can be disposed in a top-most position adjacent the highest level height adjustment holes of vertical members 120 and 130. Pins 140 and 150 can be inserted through locking holes 115 and 116, respectively, into the top-most height adjustment hole of vertical members 120 and 130, respectively. Accessory attachments 160 and 170 can be disposed in the outer-most of the plurality of accessory holes 119. In this configuration, the exercise bar may be ideally situated for traditional pushups aided by the height of the elongated member 110.

The height of the elongated member 110 can be adjusted by removing pins 140 and 150, and sliding the elongated member 110 along vertical members 140 and 150 until locking holes 115 and 116 are adjacent height adjustment holes (e.g. 121 and 131) of a desired height. The accessory attachments 160 and 170 can be adjusted by lifting the accessory attachments 160 and 170 from the elongated member 110 so that the protrusions 161 and 171 are withdrawn from the plurality of accessory holes 119. The accessory attachments 160 and 170 can be repositioned by inserting the protrusions 161 and 171 into different ones of the plurality of accessory holes 119.

Preferred embodiments of the invention are made from wood and particularly hardwoods such as oak, hickory, or ash. Preferred embodiments of the invention can be made from all organic materials and utilize only techniques of wood joinery and organic glue to minimize environmental impacts if the exercise bar 100 is discarded in a landfill. Preferred embodiments of the invention do not use metal or plastic fasteners or components. Notwithstanding, components of the invention can be made from any suitable materials, including wood, plastic, metal, rubber, or silicone and the invention is not limited to the selection of particular materials.

Figure 3:
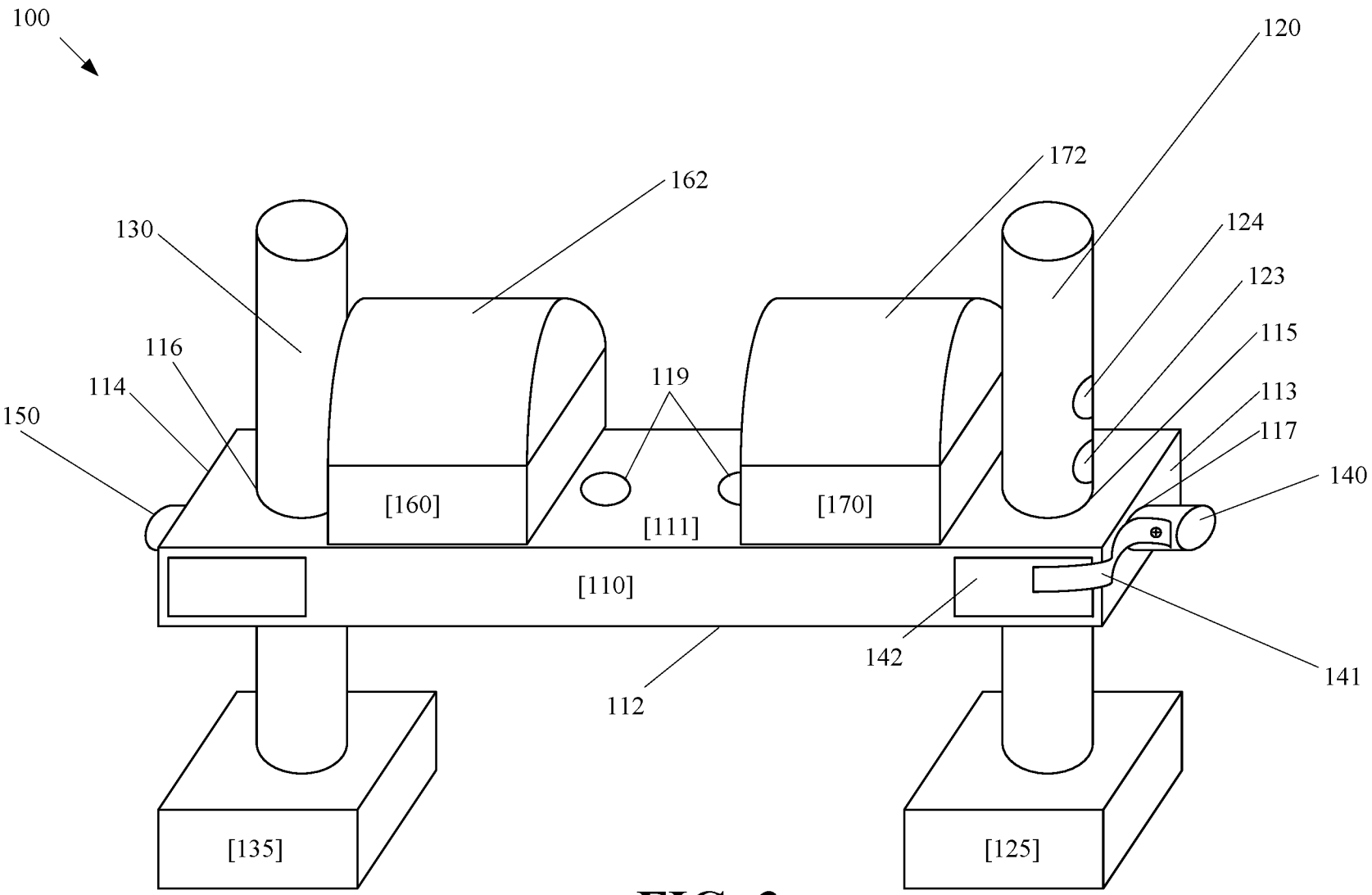
FIG. 3 is an isometric view of an exercise bar according to an exemplary embodiment of the invention.

With reference to FIG. 3, the elongated member 110 of an exercise bar 100 can be adjusted to varying heights. In particular, in FIG. 3, the elongated member 110 is disposed in a lower position to the ground than in FIG. 1. A lower elongated member 110 can make exercises more difficult for more advanced users. To adjust the exercise bar, the pins 140 and 150 can be removed from locking holes 117 and 118 (FIG. 5) so that the vertical members 120 and 130 slide freely within boreholes 115 and 116, respectively, of the elongated member 110. The elongated member 110 can then be adjusted to the desired height. The elongated member 110 can be locked in place by re-inserting the pins 140 and 150 into locking holes 117 and 118 (FIG. 5) so that the pins 140 and 150 pass through the locking holes 117 and 118 (FIG. 5) into the boreholes 115 and 116. One of the height adjustment holes (e.g. 121-124) of vertical member 120 is preferably positioned such that the pin 140 enters the locking hole 117, passes through the elongated member 110 into the borehole 115, and enters one of the height adjustment holes 121-124. Similarly one of the height adjustment holes of vertical member 130 is preferably positioned such that the pin 150 enters the locking hole 118 (FIG. 5), passes through the elongated member 110 into the bore hole 116, and enters one of the height adjustment holes 131, 132, or others (not shown.)

Figure 4:
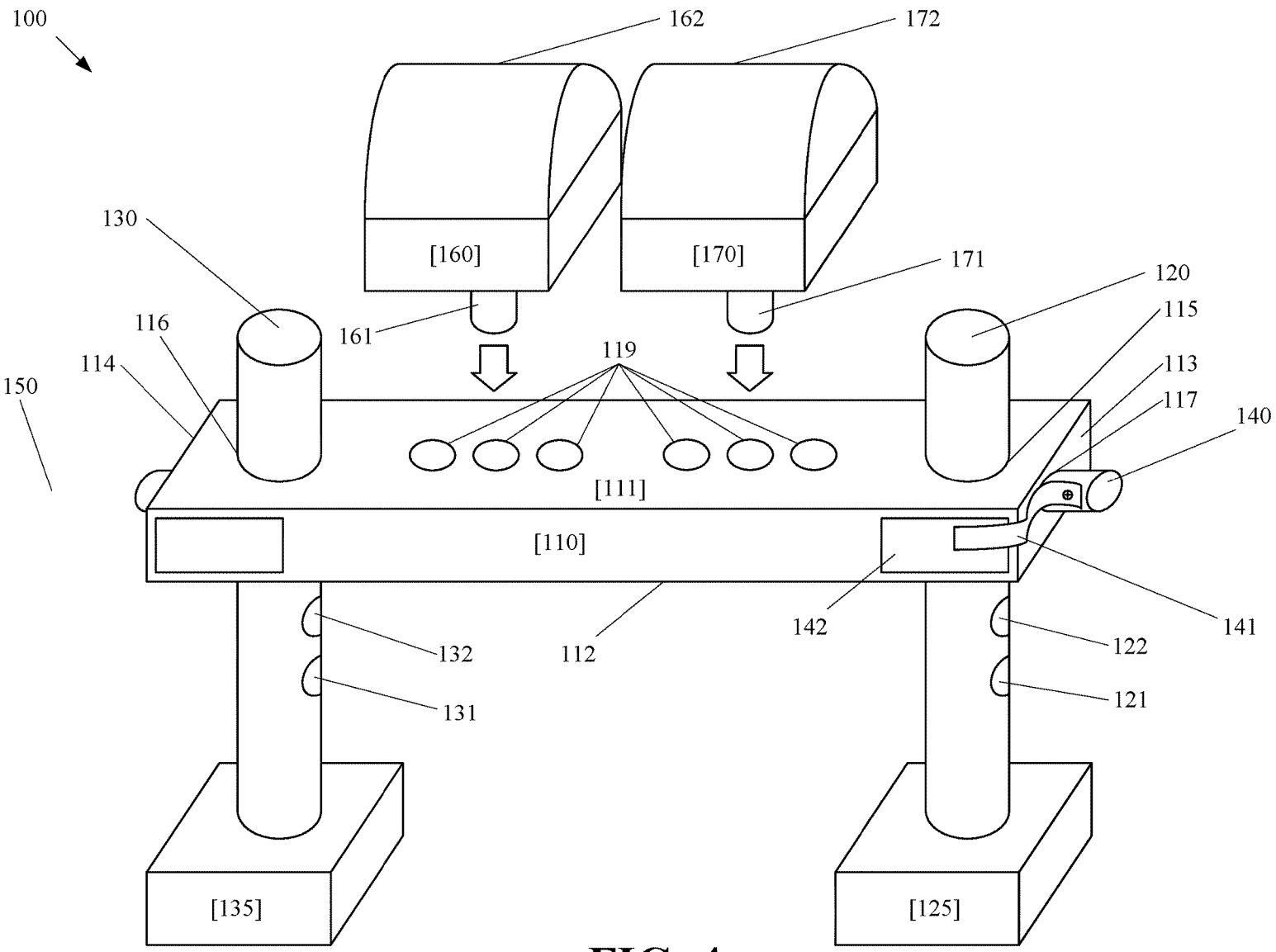
FIG. 4 is an isometric view of an exercise bar according to an exemplary embodiment of the invention.

With reference to FIG. 4, the accessory attachments 160 and 170 can be positioned along the elongated member 110 in accordance with user preference. In the embodiment of FIG. 4, the accessory attachments 160 and 170 are close together. In contrast, in FIG. 1, the accessory attachments 160 and 170 are far apart. Disposing accessory attachments 160 and 170 in close proximity can exercise different muscle groups when doing pushups or other exercises with the exercise bar 100.

The accessory attachments 160 and 170 can be held in the accessory holes 119 of the elongated member 110 by gravity and friction. The accessory attachments 160 and 170 can be removed by pulling them away from the elongated member 110. The elongated member is shown in the figures as having six accessory holes. Those of skill in the art will appreciate, however, that the invention is not limited to the number of accessory holes nor in the placement of accessory holes. Additionally, while the invention is shown as having accessory attachments 160 and 170 that have generally ergonomic convex tops ideally suited for pushups, other accessory attachments are contemplated and within the scope of the invention including, handles, balls, plates, and varying shapes and sizes of grips. Such other accessory attachments may be advantageous for other types of exercises.

Figure 5:
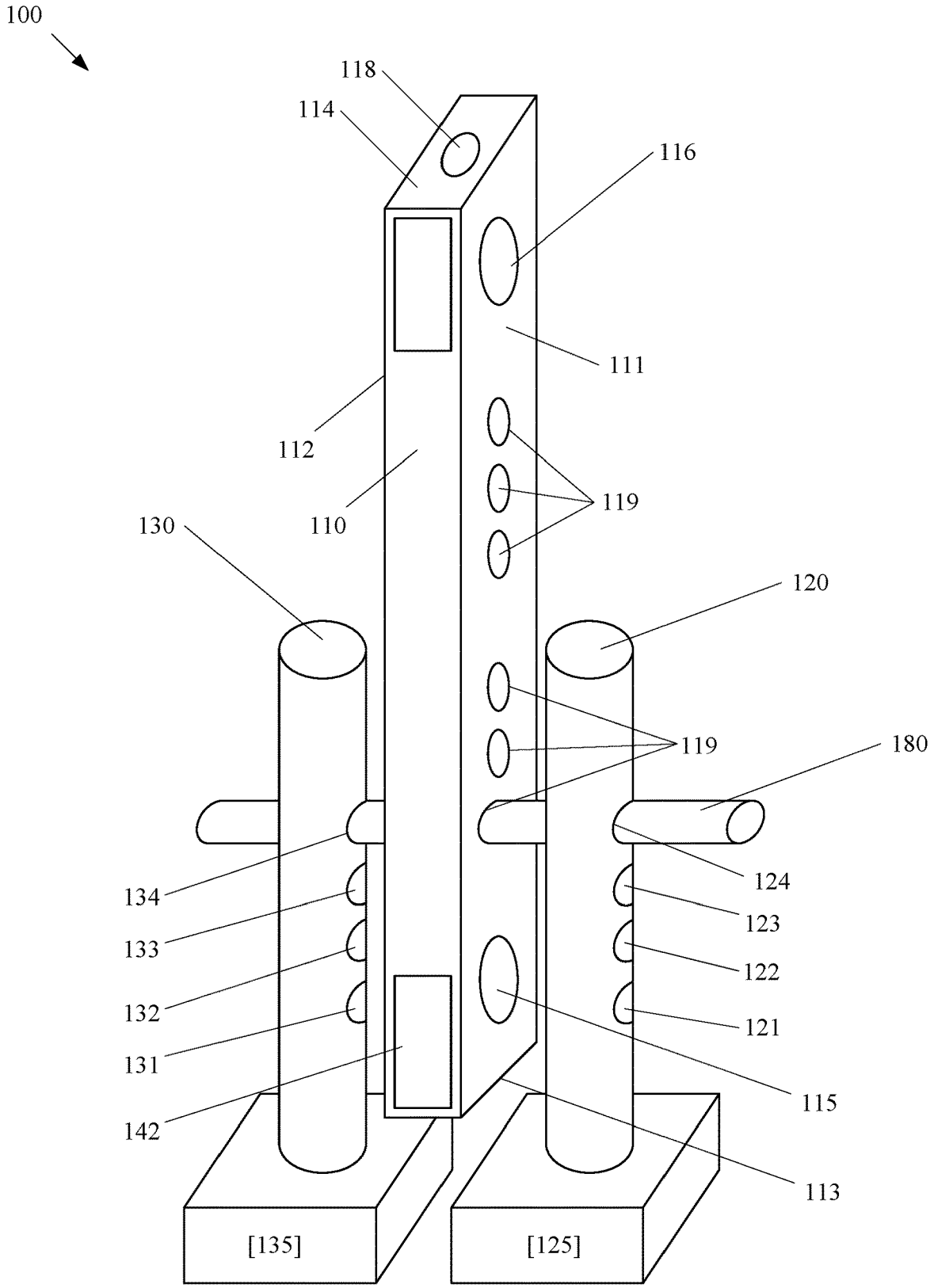
FIG. 5 is an isometric view of an exercise bar in a storage position according to an exemplary embodiment of the invention.

FIG. 5 is an isometric view of an exercise bar in a storage position according to an exemplary embodiment of the invention. As shown in FIG. 5, the components of the exercise bar 100 can be oriented to hold the elongated member 110 in a vertical configuration for storage. In the storage position, pins (FIGS. 1, 140 and 150) can be removed and the vertical members 120 and 130 can be slidably separated from boreholes 115 and 116 of elongated member 110. A stowage pin 180 can be inserted through height adjustment hole 124 of vertical member 120, through one of the plurality of accessory holes 119 of the elongated member, and through height adjustment hole 134 of vertical member 130. The accessory holes 119, height adjustment holes 124 and 134, and the stowage pin 180 can be non-round so that the elongated member 110 does not rotate about the stowage pin 180. Although not shown in FIG. 5, the accessory attachments 160 and 170 of FIG. 1 can be stored by inserting them into unused accessory holes 119 and the pins 140 and 150 of FIG. 1 can be stored by inserting them into unused height adjustment holes 121-123 and 131-133.

It will be apparent to those skilled in the art that various modifications and variations can be made in the exercise bar without departing from the spirit or scope of the invention. Thus, it is intended that embodiments of the invention cover the modifications and variations of this invention provided they come within the scope of the appended claims and their equivalents.

What is claimed is:

1. An exercise device, comprising:

an elongated body having a top surface, a bottom surface, a first end surface, and a second end surface;

a first bore hole located proximate the first end surface, the first bore hole extending from the top surface through to the bottom surface;

a first vertical member sized in relative proportions to be slidably received in the first bore hole;

a first locking hole orthogonal to the first bore hole;

a first pin sized in relative proportions to be slidably received in the first locking hole;

a first height adjustment hole of the first vertical member, the first height adjustment hole sized in relative proportions to slidably receive the first pin;

a stowage pin, the stowage pin sized in relative proportions to be slidably received in the first height adjustment hole of the first vertical member, an accessory hole disposed on a top surface of the elongated body, and a second height adjustment hole of a second vertical member;

wherein the exercise device is configured to be disposed in a first position where the elongated body is disposed perpendicular to the first vertical member and a second position where the elongated body is disposed parallel to the first vertical member.

2. The exercise device of claim 1 further comprising:

a second bore hole located proximate the second end surface, the second bore hole extending from the top surface through to the bottom surface;

a second vertical member sized in relative proportions to be slidably received in the second bore hole;

a second locking hole orthogonal to the second bore hole;

a second pin sized in relative proportions to be slidably received in the second locking hole; and a second height adjustment hole of the second vertical member, the second height adjustment hole sized in relative proportions to slidably receive the second pin.

3. The exercise device of claim 1 further comprising:
a plurality of accessory holes on the top surface of the elongated body.

4. The exercise device of claim 3 further comprising:
a first accessory attachment, the first accessory attachment having a projection sized in relative proportions to be slidably received in one of the plurality of accessory holes.

5. The exercise device of claim 4 further comprising:
a convex top of the first accessory attachment.

6. The exercise device of claim 1 wherein, in the first position the first vertical member is disposed in the first bore hole; and
wherein in the second position, the first vertical member is disposed orthogonal to the first bore hole.

7. The exercise device of claim 1 further comprising:
a retention member connected to the first pin and the elongated body.

8. An exercise device, comprising:
an elongated body having a top surface, a bottom surface, a first end surface, and a second end surface;
a first bore hole located proximate the first end surface, the first bore hole extending from the top surface through to the bottom surface;
a first vertical member sized in relative proportions to be slidably received in the first bore hole;
a first plurality of height adjustment holes of the first vertical member;
a second bore hole located proximate the second end surface, the second bore hole extending from the top surface through to the bottom surface;
a second vertical member sized in relative proportions to be slidably received in the second bore hole;
a second plurality of height adjustment holes of the second vertical member;
a stowage pin, the stowage pin sized in relative proportions to be slidably received in one hole of the first plurality of height adjustment holes of the first vertical member, an accessory hole disposed on a top surface of the elongated body, and one hole of the second plurality of height adjustment holes of the second vertical member;
wherein the exercise device is configured to be disposed in a first position where the elongated body is disposed perpendicular to the first vertical member and a second position where the elongated body is disposed parallel to the first vertical member.

9. The exercise device of claim 8 further comprising:
a first locking hole disposed on the first end surface and extending orthogonally through to the first bore hole;
a first pin sized in relative proportions to be slidably received in the first locking hole and one hole of the first plurality of height adjustment holes;
a second locking hole disposed on the second end surface and extending orthogonally through to the second bore hole; and
a second pin sized in relative proportions to be slidably received in the second locking hole and one hole of the second plurality of height adjustment holes.

10. The exercise device of claim 8 further comprising:
a plurality of accessory holes on the top surface of the elongated body.

11. The exercise device of claim 10 further comprising:
an accessory attachment, the accessory attachment having a projection sized in relative proportions to be slidably received in one of the plurality of accessory holes.

12. The exercise device of claim 11 further comprising:
a convex top of the first accessory attachment.

13. An exercise device, comprising:
an elongated body having a top surface, a bottom surface, a first end surface, and a second end surface;
a first bore hole located proximate the first end surface, the first bore hole extending from the top surface through to the bottom surface;
a first vertical member sized in relative proportions to be slidably received in the first bore hole;
a second bore hole located proximate the second end surface, the second bore hole extending from the top surface through to the bottom surface;
a second vertical member sized in relative proportions to be slidably received in the second bore hole;
a plurality of accessory holes on the top surface of the elongated body;
a first accessory attachment having a convex top and a first projection sized in relative proportions to be disposed in one of the plurality of accessory holes; and
a second accessory attachment having a convex top and a second projection sized in relative proportions to be disposed in another one of the plurality of accessory holes;
a stowage pin, the stowage pin sized in relative proportions to be slidably received in a first height adjustment hole of the first vertical member, one hole of the plurality of accessory holes disposed on a top surface of the elongated body, and a second height adjustment hole of the second vertical member;
wherein the exercise device is configured to be disposed in a first position where the elongated body is disposed perpendicular to the first vertical member and a second position where the elongated body is disposed parallel to the first vertical member.

14. The exercise device of claim 13 further comprising:
a first plurality of height adjustment holes of the first vertical member;
a second plurality of height adjustment holes of the second vertical member;
a first locking hole extending orthogonally through to the first bore hole;
a second locking hole extending orthogonally through to the second bore hole;
a first pin sized in relative proportions to be slidably received in the first locking hole and one hole of the first plurality of height adjustment holes; and
a second pin sized in relative proportions to be slidably received in the second locking hole and one hole of the second plurality of height adjustment holes.

* * * * *